US007128496B2

(12) United States Patent
Rogers et al.

(10) Patent No.: US 7,128,496 B2
(45) Date of Patent: Oct. 31, 2006

(54) VEHICLE BARRIER SYSTEM

(75) Inventors: Robert M. Rogers, New York, NY (US); Scott Demel, Brooklyn, NY (US); Lissa Parrott, New York, NY (US); Vincent Lee, Brooklyn, NY (US); Vanessa Keith, New York, NY (US); Graeme Waitzkin, New York, NY (US)

(73) Assignee: Rock Twelve, LLC, New York, NY (US)

( * ) Notice: Subject to any disclaimer, the term of this patent is extended or adjusted under 35 U.S.C. 154(b) by 0 days.

(21) Appl. No.: 10/897,417

(22) Filed: Jul. 21, 2004

(65) Prior Publication Data

US 2006/0018711 A1 Jan. 26, 2006

(51) Int. Cl.
*E01F 15/08* (2006.01)

(52) U.S. Cl. ..... 404/7; 404/10

(58) Field of Classification Search ..... 404/6, 404/7, 9, 10, 12, 15, 19, 27
See application file for complete search history.

(56) References Cited

U.S. PATENT DOCUMENTS

| | | | | |
|---|---|---|---|---|
| 1,960,053 | A * | 5/1934 | Godwin | 404/8 |
| 2,493,755 | A * | 1/1950 | Ferrill, Jr. | 180/168 |
| 3,066,896 | A | 12/1962 | Schirtzinger | |
| 3,393,161 | A | 7/1968 | Avis et al. | |
| 3,659,812 | A * | 5/1972 | Carlsson | 244/114 R |
| 3,967,704 | A * | 7/1976 | Ogden | 404/6 |
| 3,969,851 | A * | 7/1976 | Whitacre | 52/98 |
| 4,352,484 | A | 10/1982 | Gertz et al. | |
| 4,909,661 | A | 3/1990 | Ivey | |
| 5,193,764 | A | 3/1993 | Larratt et al. | |
| 5,885,025 | A | 3/1999 | Angley et al. | |
| 5,902,068 | A | 5/1999 | Angley et al. | |
| 6,726,400 | B1 | 4/2004 | Angley et al. | |
| 2003/0108387 | A1 * | 6/2003 | Airikkala et al. | 404/6 |

FOREIGN PATENT DOCUMENTS

EP 1306488 A2 * 5/2003

OTHER PUBLICATIONS

ESCO Arresting Systems, "Making Airports Safer", undated, (6 pgs.).

* cited by examiner

*Primary Examiner*—Thomas B. Will
*Assistant Examiner*—Alexandra Pechhold
(74) *Attorney, Agent, or Firm*—Foley & Lardner LLP

(57) ABSTRACT

An adaptable barrier system protects a site of value that is adjacent to a trafficable surface, from impact by a vehicle. The system includes traffic patterns to reduce speed, followed by a first impact element that causes a vehicle to become elevated from the trafficable surface. A bed having a deformable structure or material beyond the first impact element lowers the elevation of a vehicle that encounters the bed. A cover overlies the compressible material to allow passage of pedestrians and lightweight vehicles. An impact element line beyond the bed has sufficient height to impact a chassis of the vehicle having an elevation that is lowered by the bed, and prevent further progress of the vehicle. The combination of the first impact element, the bed and the impact elements line may be reproportioned with respect to each other to provide a barrier intended to suit a particular application.

62 Claims, 4 Drawing Sheets

VEHICLE BARRIER SYSTEM

FIELD

The present invention relates to an installed vehicle barrier system that protects at-risk sites from vehicle born attacks. The present invention of the barrier system uses a combination of a number of vehicle attenuating devices to prevent the passage of vehicles. These devices include a traffic control zone, followed by a first impact element that is backed by a bed of deformable material, and followed by a second impact element.

BACKGROUND

Barriers for restricting the passage of vehicles (such as automobiles, trucks, busses, airplanes and the like) are generally known. Barriers that are fixed in the roadway, meaning they do not move by device or mechanism, are typically categorized as "passive" or "inoperable" barriers. These types of barriers are either removably placed on the roadway or sidewalk surrounding an at-risk site, or they are installed into the ground or built into the landscape/streetscape. Known installed "passive" barriers typically include foundation walls (typically at least 36" high), or bollards in the form of "posts" embedded in a concrete foundation, and beds of a crushable material (such as concrete). Walls and bollards are intended to stop vehicles through impact resistance, having sufficient shear strength to remain intact at impact and relying on the inertia of their foundations to bring a vehicle to a halt.

In addition to vehicle barrier systems, vehicle arresting systems are also known. Where vehicle barrier systems are intended to immediately stop a vehicle, vehicle arresting systems are intended to control the stopping of a vehicle over a given time and/or distance. Known arresting systems include beds of a crushable material (such as concrete), fences and gates, and cable and elastic (e.g. "bungee cord") systems. Crushable beds tend to utilize the interaction between the bed and the tire(s) of the vehicle. As a vehicle moves across the crushable material, the weight of the vehicle causes it to sink into the bed. At the same time, the spinning of the tire "rips" through the crushable material. As the vehicle drops farther into the bed, the tires' rotation tends to become slower until finally the vehicle is stopped. For example, crushable beds at the ends of aircraft runways for aircraft that "overshoot" the runway are generally known for gradually decelerating the aircraft over an extended distance to minimize injury to occupants and damage to the aircraft. Examples of such crushable bed systems are described in U.S. Pat. Nos. 5,885,025; 5,902,068 and 6,726,400.

These known vehicle barriers present a number of functional problems. Walls significantly impede pedestrian traffic and can cause pedestrian "herding" and "bottle necking." Additionally, walls, and bollards as well, are somewhat visually restricting. The inherent height of the two, that is necessary for their function as a vehicle barrier, reduces the visual "openness" of the landscape/streetscape. Crushable beds are not optimal because they typically require an extended length of the crushable bed (upwards of 50 feet or more) to arrest a vehicle (and substantially longer for aircraft and the like). Such long lengths are generally not compatible with most urban applications, where space between a roadway and a building line or perimeter line is fairly small (e.g. 5–30 feet) and a primary objective of the barrier is to stop the progress of the vehicle within a relatively short distance. Such known vehicle barrier systems tend to provide limited application and flexibility to designers in providing an effective vehicle barrier system intended to meet applicable government performance standards, and is minimally obtrusive, for use in areas such as urban settings that typically have limited space for installation of such barriers.

Accordingly, it would be desirable to provide an installed vehicle barrier system or the like of a type disclosed in the present Application that include any one or more of these or other advantageous features:

1. A system providing a barrier that is resistant to unauthorized breach by vehicles.
2. A system that minimizes the restriction of pedestrian traffic flow.
3. A system that provides a less visually obtrusive installed vehicle barrier system.
4. A system that stops a vehicle in the short distance between a roadway and the protected site.
5. A system that rapidly arrests a vehicle without regard to vehicle damage.
6. A system that is integrated into the landscape/streetscape, employing similar elements such as curbs, sidewalks, benches, etc.
7. A system that combines a trafficable roadway surface, a curb, a bed of compressible material covered by a surface cover layer, and a low wall line or low bollard line.
8. A system in which the required height of the impact element line is interdependent with the characteristics of the bed of compressible material, so that the various components of the system may be adjusted to suit the needs of a particular application.

SUMMARY

One embodiment of the present invention relates to a barrier system for use between a roadway and a site requiring protection from advancing vehicles. The system includes a trafficable surface and a first impact element (such as a "curb" as typically included along an edge of a trafficable surface). The trafficable surface may include certain features to reduce the speed of an approaching vehicle before reaching the first impact element. Such features include frictional elements and barriers arranged to create traffic flow patterns. Vehicles that reach the first impact element will have their trajectory redirected upwardly from impact with the curb. Beyond the first impact element is a deformable bed intended to lower the elevation of a vehicle that encounters the bed by including a material or infrastructure configured to collapse, breakaway, crush, compress, yield or otherwise deform under the weight of the vehicle when the vehicle descends onto the bed after impacting the first impact element. The bed may be contained in a confining structure such as a foundation and topped by a surface cover layer at a substantially equivalent elevation with the top of the first impact element, configured to spread the weight of loads due to pedestrian and the like. Beyond the bed a second impact element in the form of an impact element line extends upwardly from grade level, separating the barrier system from a protected zone adjacent to a site requiring protection. The components of the system may be flexibly adapted in various combinations to suit installation in a particular application while providing performance that is consistent with applicable barrier performance standards.

DETAILED DESCRIPTION

According to the illustrated embodiment, the vehicle barrier system provides an arrangement or combination of installed, vehicle arresting and barrier devices to be used along a security perimeter to create an area 5 protected from vehicle intrusion (e.g. to provide protection of facilities, buildings, restricted areas, etc.). This arrangement of vehicle arresting and barrier devices is intended to stop vehicles within a relatively short distance traveling at varying rates of speed, according to pre-established crash barrier rating systems and/or criteria. The vehicle barrier system is shown composed of a combination of distinct regions (shown for example as four regions). A vehicle attempting to breach the security perimeter may progressively encounter all four of these regions and each region, in turn, is intended to reduce the vehicle's speed or control the vehicle's approach and thus reduce its speed.

A first region includes a trafficable surface (e.g. asphalt, concrete, paving, etc.) using friction and/or traffic patterns to slow the vehicle (e.g. traffic patterns, friction elements, etc.), as the surface material can have a higher coefficient of friction than a traditional asphalt roadway. After encountering the first region, the vehicle may encounter a second region.

The second region includes an upwardly extending first impact element 2 (e.g. a fixed barrier, or vertical element, shown for example as a "curb," etc.) disposed at the edge of the trafficable surface 1 or other desired location. The curb 2 is intended to reduce the vehicle's speed through inertial impact resistance. The curb 2 also serves to cause the vehicle to be directed at least partially upward (e.g. "jump"), where the vehicle's front wheels temporarily lose contact with the trafficable surface as the vehicle's trajectory is redirected upwardly from the impact with the curb. After the vehicle impacts the curb 2, the vehicle moves upward and forward and descends upon a third region.

Figure 5:
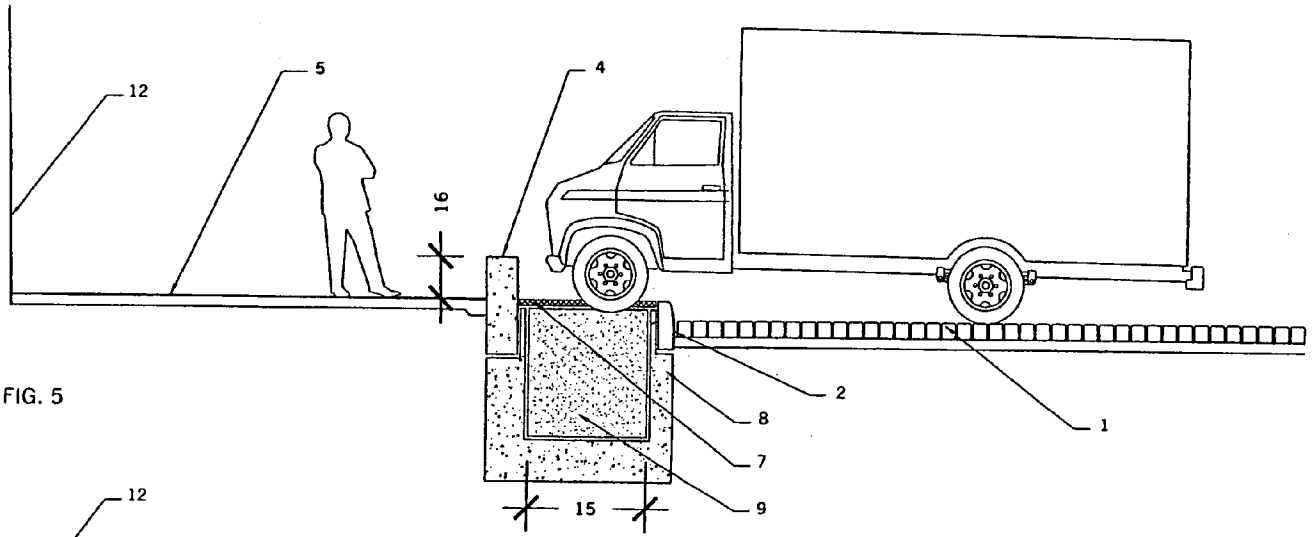
FIG. 5 is a schematic representation of a sectional view of a vehicle entering the compressible bed of the barrier system of FIG. 1 and FIG. 2.
Figure 6:
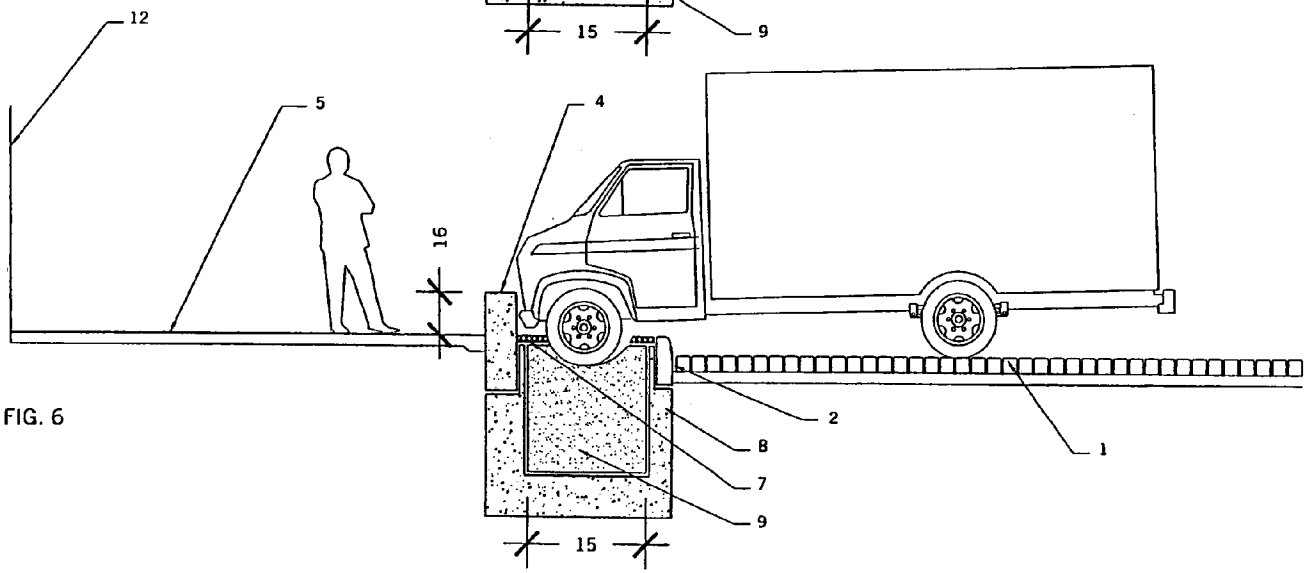
FIG. 6 is a schematic representation of a sectional view of a vehicle impacting the impact element line of the barrier system of FIG. 1 and FIG. 2.

The third region includes a deformable zone 3. The deformable zone 3 is intended to lower the elevation of the vehicle below the top of curb 2 by providing a bed 9 having an infrastructure or material that is configured to collapse, breakaway, crush, compress, yield or otherwise deform under the weight of the vehicle when the vehicle descends onto the bed after impacting the curb (see FIGS. 5–6). According to a preferred embodiment, the bed 9 of the deformable zone 3 has a length 15 within a range of one foot to thirty feet, and a depth 17 having any suitable depth for containing a deformable infrastructure or material intended to lower the elevation of a vehicle that encounters bed 9 by a sufficient amount so that a structural portion of the vehicle contacts the impact element line in the event that the vehicle traverses the entire length 15 of bed 9. However, the length and depth may have any suitable dimensions for use in combination with a curb 2 and impact element line 4 for installation in a particular application. The deformable zone 3 is shown to include a cover surface layer 7 (e.g. paving, concrete, sedum, planting, soil, etc.) disposed on the surface of bed 9. The cover surface layer 7 is intended to spread relatively smaller bearing loads (e.g. pedestrian, horse, carts, handtrucks, etc.), so as not to substantially deflect (or otherwise fail) under such loads or deform the deformable infrastructure or material of bed 9 below. The cover surface layer 7 is designed to fail under higher bearing loads and higher impact loads resulting from vehicles (e.g. automobiles, trucks, buses, etc.) having a sufficient weight (e.g. weighing at least approximately 2,500 lbs, and either crack (in the case of, for example, concrete, paving, etc.) or deflect (in the case of, for example, sedum, planting, etc.) so that the vehicle's weight bears on the deformable infrastructure or material of bed 9 below.

According to a preferred embodiment, the bed 9 comprises a deformable structure (e.g. lattice, honeycomb, etc.) constructed of metal, polycarbonate, plastic, composite metal, wood, etc. and configured to breakaway, collapse, crush, sink or otherwise deform under the weight of the vehicle. The bed 9 may also comprise a material (e.g. uniform or composite), alone or in combination with a structure, having characteristics that permit the material to crush, compress, yield, displace, or otherwise deform, such as, for example, cellular concrete, metallic foam, synthetic foam, or any other suitable material of combination of such materials, having a predefined compression strength, sufficient to crush under a tire(s) of a vehicle weighing at least approximately 2,500 pounds (lbs). The vehicle's weight combined with the rotation (e.g. "spinning" etc.) of the vehicle's tires is intended to deform (e.g. collapse, crush, compress, yield, displace, etc.) the deformable structure or material 9, so that the elevation of the vehicle "drops" or is otherwise "lowered." The deformation of the structure or material of bed 9 tends to lower the effective height of the vehicle, as the elevation of the vehicle decreases (e.g. sinks, falls, etc.) into the bed 9, as well as reducing the vehicle's speed, due at least in part to the friction between the tires and the compressible structure of material. The desired deformability (e.g. strength, compressibility, etc.) of the structure or material of bed 9 will generally be determined by the length 15 of bed 9 and the height 16 of the impact element line 4 (shown for example as a low wall, etc.) backing the bed, on a case-by-case basis considering the available length for placement of the bed and the available height for the impact element line 4. For example, if the area available for the bed is relatively short, then there will be a relatively small "drop" in elevation of the vehicle within the bed (as the vehicle traverses the length of the bed) and the impact element line 4 (e.g. wall, bollard, etc.) should be relatively high (e.g. sufficient to contact a structural portion such as a chassis of the vehicle, accounting for the relatively small drop in elevation of the vehicle within the bed). Conversely, if the area available for the bed is relatively long, then there will be a correspondingly greater "drop" in elevation of the vehicle within the bed (as the vehicle traverses the length of the bed) and the impact element line (e.g. a wall, bollard, etc.) may be correspondingly lower (or in certain cases, for example, essentially non-existent) such that the height or elevation of the impact element line 4 remains sufficient to contact the chassis of the vehicle to prevent further progress of the vehicle into the protected zone 5.

The deformable zone 3 of the third region also includes a confining structure 8 for containing the bed 9. The confining structure (e.g. a concrete foundation, metal trough, wood form-work, fabric mesh, etc.) is shown to surround the deformable structure of material of bed 9, holding it in place, so that when the bed 9 is "loaded" it deforms and the deformed structure of material of the bed 9 is generally contained by the confining structure 8. After encountering the third region having the deformable zone 3, the vehicle may encounter a fourth region in the even that the vehicle traverses the length 15 of bed 9.

The fourth region is shown located beyond the compressible zone, and includes an impact element line 4. The impact element line (comprised of, for example, walls, bollards, posts, planters, projections, obstacles, etc.) is shown to have a sufficient height to impact a structural portion (e.g. the chassis, etc.) of the vehicle once the vehicle has dropped in elevation due to deformation of bed 9 of the deformable zone 3. The resistance provided by the impact element line 4 is intended to be sufficient to stop any consequential progress of the vehicle after encountering the trafficable surface 1, the curb 2, and the bed 9, so that the vehicle does not enter the area 5 to be protected.

In the wall or line construction of conventional vehicle barriers (e.g. "anti-ram" type, etc.) impact elements are typically specified as having a height of approximately three (3) feet tall, above a finish grade elevation. For example, in the case of the U.S. Department of State (DOS), a generally recognized national authority on vehicle barrier rating and authorization, "passive anti-ram" type impact barriers are specified to have heights within the range of 30–39 inches tall, (such as described in DOS design specifications DS-1, DS-7, and DS-50 for use with a "rigid" trafficable surface (e.g. roadway, etc)). According to the illustrated embodiment of the present invention, the height 16 of the impact element line 4 may be "lowered" or reduced by an amount corresponding to the deformability (e.g. compressibility, etc.) characteristics of the bed 9. The greater the deformability of the material, the greater the degree of deformation and corresponding "drop" in elevation of the vehicle when the vehicle encounters bed 9. As the bed's capability to deform (e.g. collapse, breakaway, compress, crush, yield, etc.) and thus lower the elevation of a vehicle increases, the height 16 of the impact element line 4 necessary to contact the chassis of a vehicle tends to decrease. The deformability of bed 9 serves to lower the effective height of a vehicle prior to encountering the impact element line 4. As the approaching vehicle encounters the bed 9, it drops below the grade of trafficable surface 1 or the height of curb 2 (based on a particular application), as its wheels "grind" through or deform the structure or material of bed 9 and the vehicle's inherent weight causes the material to deform under the bearing load of its wheels. As a result, in the event that the vehicle has traversed the length 15 of bed 9 and reached the impact element line 4, the elevation of the vehicle has been lowered in relation to the finish grade and the height 16 of the impact element line 4. The reduction in elevation of the vehicle is believed to be attributable to the length 15 of bed 9 and to the strength characteristics (e.g. yield, compressibility, deformability, etc.) of the structure or material of bed 9.

According to a preferred embodiment, the length 15 of bed 9, and the deformability of the structure or material and the height 16 of the impact element line 4 are related in an interdependent relationship and may be combined in a wide variety of combinations and permutations to accomplish the intended objective of providing an effective barrier system that is suitable for use in locations with reduced space and that provides an aesthetically and architecturally pleasing appearance. As previously described, a typical minimum height of a conventional "anti-ram" type impact element for use in connection with a conventional roadway is approximately three (3) feet. The use of the bed 9 in connection with the curb 2 and the impact element line 4 permits the height 16 of the impact element line 4 to be reduced below the conventional standard of three (3) feet, by an amount generally corresponding to the "drop" in vehicle elevation resulting from the length 15 and or the strength characteristics of the structure or material of bed 9. For example, if the strength of the structure or material of bed 9 is increased, then the length 15 of the bed and/or the height 16 of the impact element line 4 can be increased accordingly. Likewise, as the strength of the structure or material of bed 9 is reduced, then the length 15 of bed 9 and/or the height 16 of the impact element line 4 may be reduced. According to a preferred embodiment, the height 16 of the impact element line 4 for use in combination with bed 9 and the curb 2 is within a range of approximately six (6) inches to thirty (30) inches, however, other heights of the impact element line above the finish grade elevation may be used to suit an installation for a particular application, such as within a range of approximately zero (0) inches above grade to several feet or more above grade.

According to any preferred embodiment of the present invention, the interaction of the length 15 of bed 9, and the strength characteristics of the structure or material of bed 9, and the height 16 of the impact element line 4 is intended to provide an adaptable barrier system configured to ensure that the chassis of any vehicle that traverses the length 15 of bed 9 will come in contact with the impact element line 4. The barrier system of the present invention is intended to avoid the use of conventional approaches that include high walls, large impact elements and/or long expanses of crushable material. The embodiments of the present invention disclosed herein are intended to provide an adjustable and adaptable system comprising combinations of "stages" or "layers" of protective elements that provide flexibility to designers for adaptation to various applications having needs such as small installation areas, required pedestrian access, or when the barrier system is desired to be unobtrusive and to minimize the appearance of the barrier from detracting from (or drawing attention from) the surroundings.

In conventional barrier applications involving a "rigid" trafficable surface, the typical height of an impact element that is necessary to contact the chassis for most "high threat" type vehicles is approximately 18 inches. Accordingly, the Applicants believe that the height of an impact element line used in combination with a bed of a deformable structure or material according to the present invention, may be reduced by an amount corresponding to the drop in elevation experienced by the vehicle as it traverses the bed. For example, if a bed of a deformable structure or material is configured to provide a drop in elevation of the vehicle by twelve (12) inches, then the height of the impact element line may also be generally reduced by a corresponding twelve inches, in order to maintain the height of the impact element line at an effective height of 18 inches with respect to the vehicle.

Figure 1:
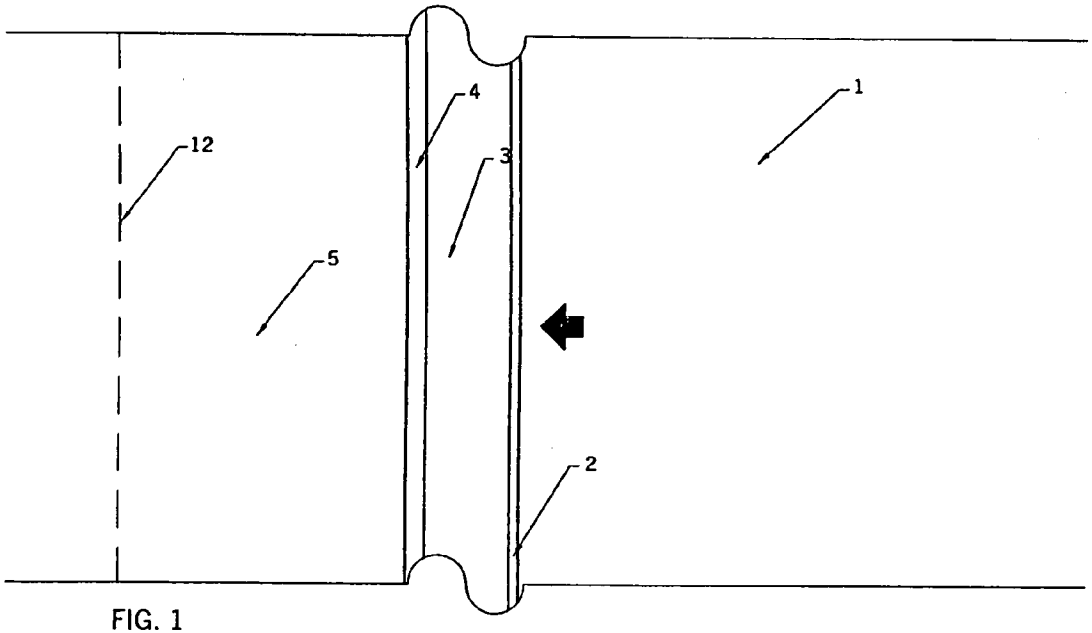
FIG. 1 is a schematic representation of a top view of the vehicle barrier system according to an embodiment.
Figure 2:
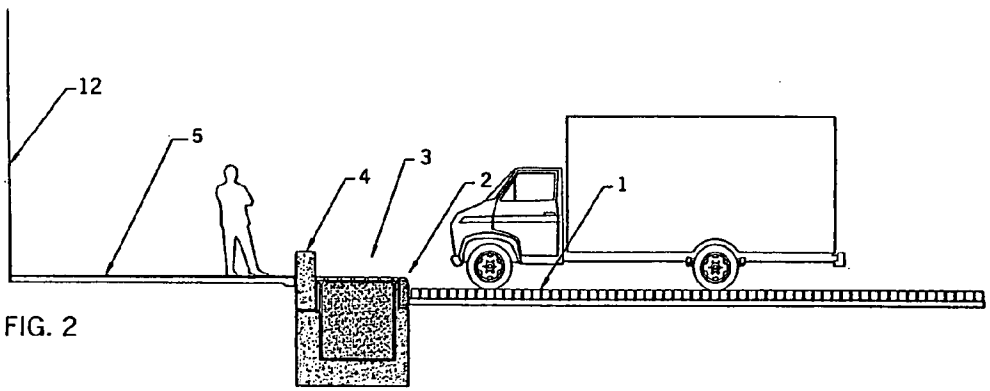
FIG. 2 is a schematic representation of a sectional view of the vehicle barrier system according to the embodiment of FIG. 1.
Figure 3:
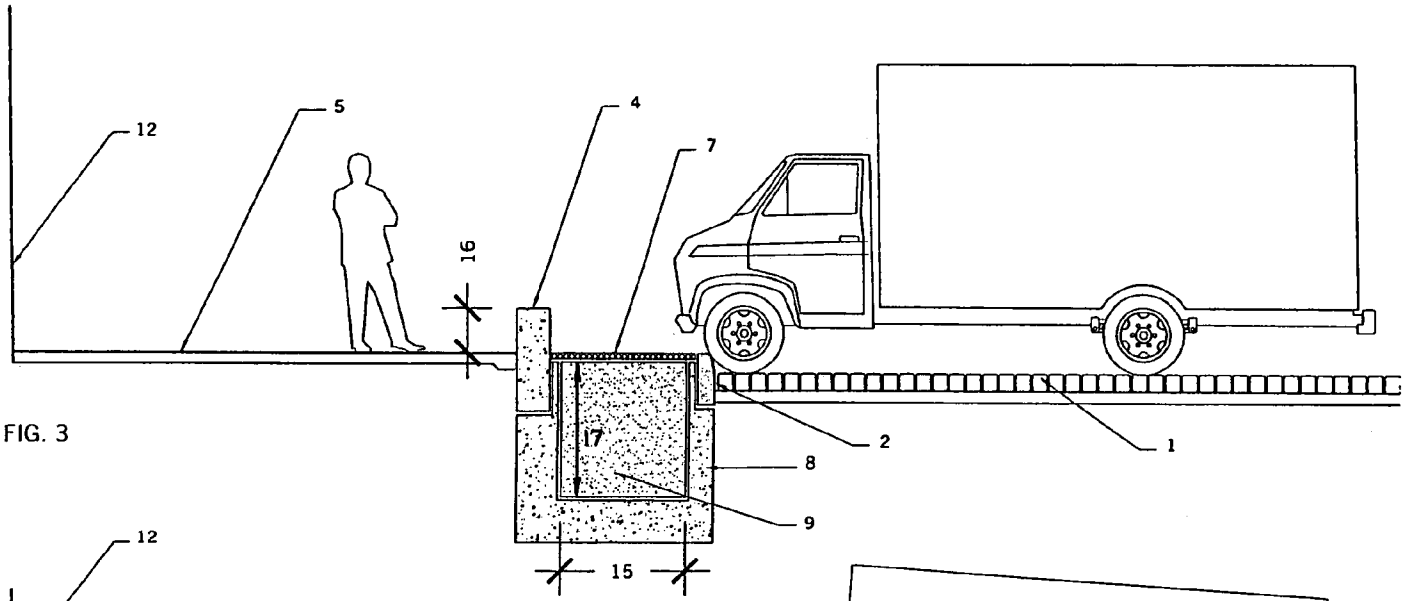
FIG. 3 is a schematic representation of a sectional view of a vehicle impacting the first impact element of the vehicle barrier system of FIG. 1 and FIG. 2.
Figure 4:
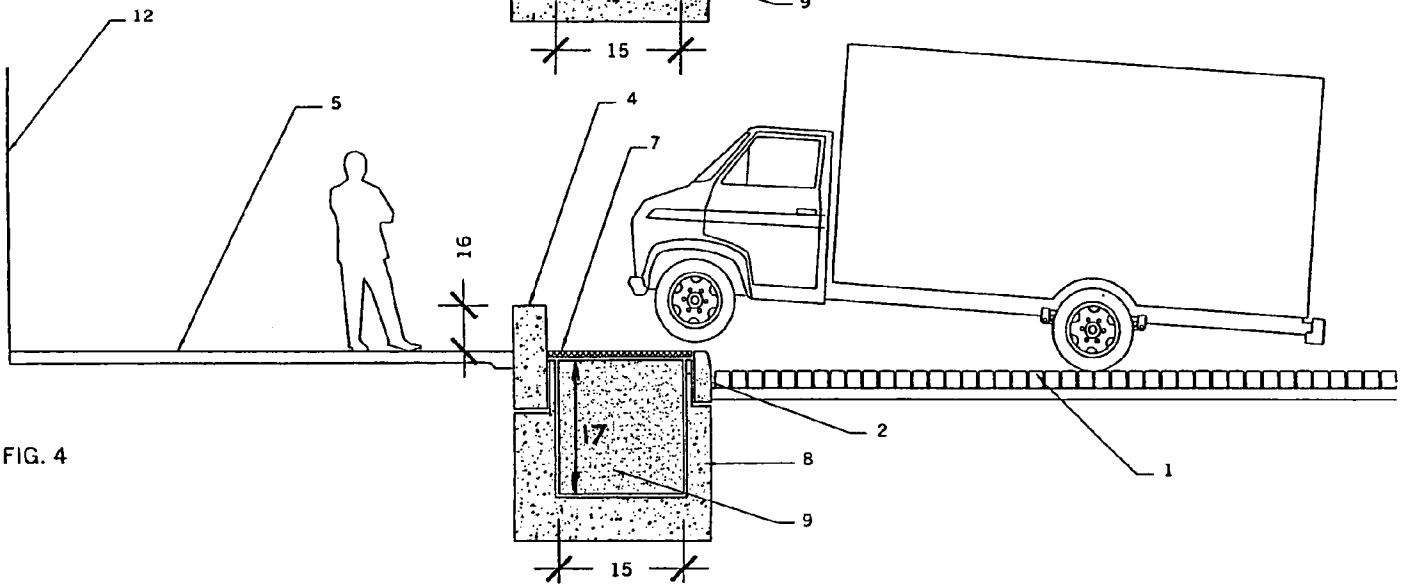
FIG. 4 is a schematic representation of a sectional view of a vehicle jumping as a result of impacting the first impact element of the vehicle barrier system of FIG. 1 and FIG. 2.

Referring to FIGS. 1 and 2, the vehicle barrier system 11 is shown according to one embodiment. The system is shown to include a trafficable surface 1, over which all vehicles can generally pass. A first impact element shown for example as curb 2 lies along the trafficable surface 1 and is backed by a compressible zone 3 and a second impact element shown as an impact element line 4. The impact element line 4 is shown to separate the barrier system from the protected region 5. Beyond the protected region 5 is shown the asset 12 (e.g. building, etc.) that is intended to be protected by the barrier system. The trafficable surface 1 may form a part of the barrier system by modifying its surface through addition of frictional elements (e.g. paving, aggregates, etc.) that allow it to contribute to the attenuation of an advancing vehicle.

Figure 7:
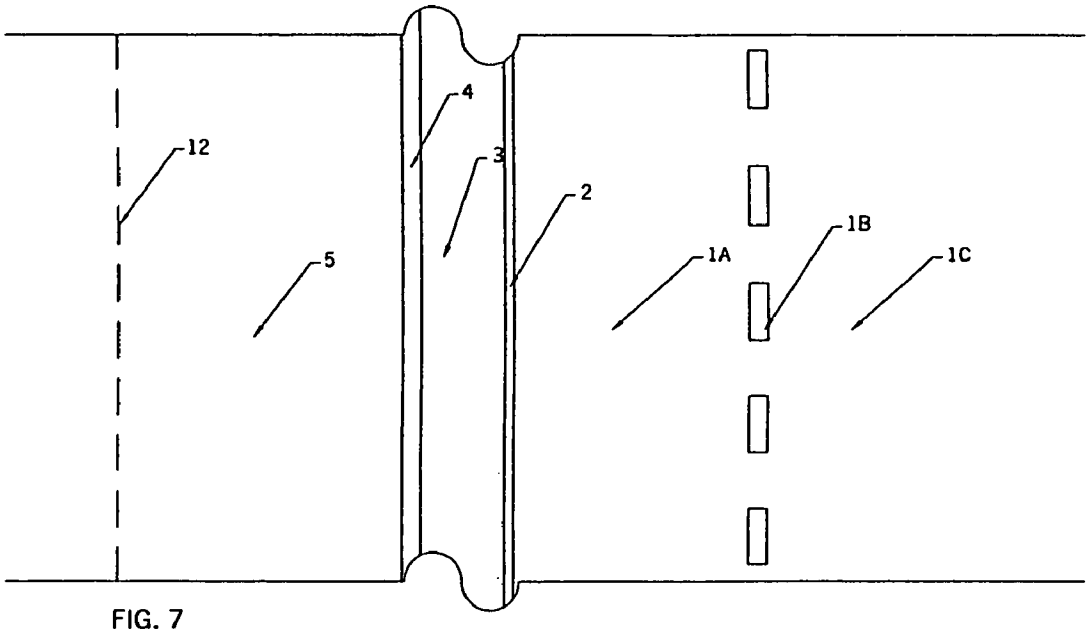
FIG. 7 is a schematic representation of a top view of the vehicle barrier system according to another embodiment.
Figure 8:
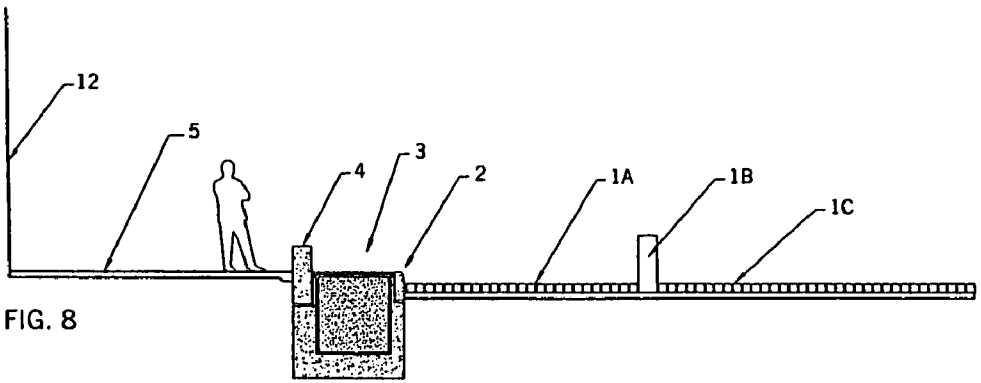
FIG. 8 is a schematic representation of a sectional view of the vehicle barrier system according to the embodiment of FIG. 7.

According to a preferred embodiment as shown in FIGS. 7 and 8, the first region including trafficable surface 1 can be comprised of three distinct sub-regions. Trafficable surface 1A is separated by a generally upright impact element (shown as a vertical element line 1B) from trafficable surface 1C. In this embodiment, vertical element line 1B (e.g. wall, bollard line, wall segment line, median, curb, tree line, planter, line of benches, etc.) serves to reduce the speed of vehicles attempting to breach the barrier system. The vertical element line 1B tends to reduce a vehicle's speed by "forcing" a vehicle to drive around the vertical element, causing the vehicle to reduce speed to maintain steering, or to drive through the vertical element, causing the vehicle to reduce speed through impact or vehicle damage or destruction. Additionally, trafficable surfaces 1A and 1C can be modified through addition of a frictional element (e.g. paving, aggregate, etc.) that is intended to improve the ability of the trafficable surfaces to contribute to the reduction in speed of an advancing vehicle.

In the embodiment shown in FIGS. 1 and 2, trafficable surface 1 can also be modified to become a vehicle attenuating device by changing the surface composition to a material (e.g. pavers, concrete or asphalt with added aggregates such as sand or stone, etc.) that has a higher coefficient of friction than a standard roadway wearing course. The curb 2 is intended to reduce the speed of the vehicle through impact, and also cause the vehicle to "jump". According to the embodiment, when the vehicle reaches the deformable zone 3, it not only bears on bed 9, but it also descends upon the surface cover layer 7 and bed 9 with a generally vertical impact force, (as shown schematically in FIG. 5). The first impact element in the form of the curb 2 may be formed of stone, reinforced concrete, wood, etc. As well, the curb may be capped with steel and/or pinned to a foundation below (not shown) for additional strength. According to a preferred embodiment, the curb 2 has a height that is typically in a range of approximately 3 inches to 12 inches high above the level of the trafficable surface, but may be provided with any suitable height for use with a barrier for intended vehicle types.

According to the illustrated embodiment the deformable zone 3 comprises a surface cover layer 7, a bed 9 having a deformable structure or material for lowering the elevation of the vehicle, and a confining structure 8. The top of surface cover layer 7 (e.g. formed from a material such as concrete, brick, pavers, tiles, cobble, planting, soil, sedum, sand, wood, plastic, etc.) is shown at approximately the same elevation as the top of the curb 2. Surface cover layer 7 serves to spread relatively small bearing loads so that bed 9, below, does not substantially deform, thus allowing pedestrians and the like (e.g. horses, light vehicles such as golf carts, hand trucks, etc.) to travel over this region of the vehicle barrier system without deforming the structure or material of bed 9 below. According to a preferred embodiment, the structure or material of bed 9 is designed to fail (e.g. deform, crush, collapse, compress, breakaway, yield, deflect, etc.) under loads generally equal or greater to the loads created by the tires of a vehicle having a weight of approximately 2,500 lbs. According to alternative embodiments, the bed may be configured for suitable deformation with vehicles having other loading conditions as determined in a particular application.

According to one preferred embodiment the bed 9 comprises a compressible material formed from cellular concrete having a compression strength within the range of approximately 30 pounds per square inch (psi) to 60 psi and formed with a substantially uniform density, such as may be commercially available from the Engineered Arresting Systems Corporation of Aston, Pa. According to an alternative embodiment, the compressible material may be other suitable materials (e.g. wood, plastics, metallic and/or polymeric materials, etc.) that are configured to crush or collapse under a predetermined loading condition, or may have different or other strength characteristics, or may have variable density (such as by containing voids of air ranging in sizes from small to large). For example, the material may be a metallic or polymeric material formed with a plurality of voids therein, such as a metallic foam or synthetic foam material, or any suitable combination of such materials and configured to compress or crush under predetermined loading conditions. By further way of example, the bed may comprises a structure configured to deform under predetermined loading conditions, such as a framework, lattice, honeycomb, or other deformable support structure and constructed of any suitable material such as metal, polycarbonate, plastic, composite metal, etc. According to other alternative embodiments, the material may be a generally incompressible material that is configured to deform under certain predetermined loading conditions, such as a liquid, slurry, gel, or other suitably deformable material.

The bed 9 is shown contained by a confining structure 8. According to a preferred embodiment, the confining structure is provided in the form of a reinforced concrete foundation (e.g. trench, pit, etc.). According to other embodiments the confining structure may be formed from a metal trough, wood form-work, fabric mesh or other suitable material. The confining structure 8 is intended to retain the structure or material of bed 9 so that when the structure or material deforms, the confining structure 8 restrains the structure or material. For example, when the material comprises a cellular concrete material, the material crushes "in place," thus the need for "empty pockets" in the confining structure and other supporting foundations (not shown), to accommodate for any displaced material can be minimized or avoided.

Referring to FIGS. 3–6 the impact element line 4 is shown as a "foundation" type impact element where the structure of the impact element extends below grade and "links" (or is otherwise coupled) to a relatively significant subsurface foundation such as, for example, the confining structure 8). Such foundation type impact elements are intended to provide a relatively "heavy" ballast material below grade to minimize the volume of the impact elements above the trafficable surface, thus increasing the ease of pedestrian access and minimizing visual obstructions along the security perimeter.

According to one embodiment, the impact elements are "bollards" formed from a shell of material (e.g. steel, etc.) having a cavity containing a fill material (e.g. cement, reinforced concrete, metal, stone, wood, plastic, etc.). The shell may include internal braces (not shown), such as steel plates, to provide additional strength. The shell and fill material may be integrally formed with a foundation below grade so that loading from vehicle impact upon the impact elements can be transferred to the foundation. Use of foundation type barriers are generally desirable for installed "permanent" type barrier systems, in which the impact elements are intended to be present for an extended time period. According to one embodiment the foundation impact elements include a steel shell filled with reinforced concrete and having a minimum cross section area of approximately 144 square inches. According to an alternative embodiment, the foundation impact element line is a wall or line of wall sections having a thickness up to and including approximately 12 inches. In the embodiments where the impact elements of the impact element line 4 are bollards or walls, the height of said impact elements is intended to be smaller than the typical 30 inch height of most conventional vehicle "anti-ram" type barriers. The height of the impact element 4 may be lower than a typical "standard height" barrier because the impact elements are backing the deformable zone 3 that tends to lower the effective height of threatening vehicles. According to an alternative embodiment, the impact elements may be provided in various shapes, sizes and materials. For example, the cross sectional area may be decreased with the use of higher strength materials or the cross sectional area may be increased with the use of lower strength materials, etc. According to another alternative embodiment where the impact element line is made up of bollards, the bollards may be connect by beams (e.g. steel, concrete, reinforced concrete, wood, etc.). According to a further alternative embodiment where the impact element line is made up of bollards connected or linked by beams or low walls, these impact elements may be covered in a suitable pedestrian seating material (metal, wood, concrete, glass, etc.) and used as a bench or other suitable article.

According to a particularly preferred embodiment the trafficable surface 1 (e.g. roadway, parking lot, etc.) includes trafficable surfaces 1A and 1C separated by a vertical element 1B. Vertical element 1B is shown as a low concrete wall configured to separate traffic from surfaces 1A and 1C. Surfaces 1A and 1C may be formed from standard roadway asphalt or the like. The first impact element in the form of a curb 2 is preferably a granite curb that is "pinned" to a foundation below the trafficable surface 1. The curb 2 preferably extends approximately six (6) inches above the grade of the trafficable surface 1, and is six (6) inches in length. The foundation is shown continuous with the confining structure 8 that contains the structure or material of bed 9. The confining structure 8 is preferably a reinforced concrete foundation having a depth 17 that is approximately four (4) feet deep. Contained in the concrete foundation of the confining structure 8 is a deformable material preferably made from a crushable cellular concrete material having a compressive strength within a range of approximately 30–60 psi. The bed 9 preferably has dimensions of approximately 48 inches in length, 36 inches in depth, and may have any suitable width to accommodate the intended application. Above the bed 9 having the deformable material is shown the surface cover layer 7. Surface cover layer 7 is preferably made from stone pavers or the like and has a depth of approximately three (3) inches. As shown in FIGS. 3–6, the top of the surface cover layer 7 is preferably at approximately the same elevation as the top of curb 2. Beyond the bed 9 is shown the impact element line 4. Impact element line 4 preferably comprises either a low wall formed from one or more sections extending approximately sixteen (16) inches above the top of cover layer 7, and having a length of approximately twelve (12) inches and may have any suitable width corresponding to the width of bed 9. Alternatively, the impact element line may formed from rows of bollards comprising steel shells containing concrete or the like and having a diameter within the range of approximately twelve (12) inches to sixteen (16) inches, and a height of approximately sixteen (16) inches above the surface layer. According to the embodiment, the bollards are configured in groups of at least two and spaced at intervals of approximately 48 inches on center.

According to another preferred embodiment the first impact element 2 is a granite curb that is "pinned" to a foundation below grade. The curb 2 extends approximately six (6) inches above the trafficable surface 1, and is approximately six (6) inches in length. The foundation is preferably substantially continuous with the confining structure 8 that contains the structure or material of bed 9. The confining structure 8 is preferably a reinforced concrete foundation that is approximately 48 inches deep. Contained in the concrete foundation 8 is the bed 9 having a deformable material preferably made from crushable cellular concrete or the like and having a compressive strength within the range of approximately 30–60 psi. The bed 9 preferably has dimensions of approximately 20 feet in length, 36 inches in depth, and variable width to accommodate the intended application. Shown above bed 9 is the surface cover layer 7 that is preferably a sedum planting or the like, such as typically used in green roof installations, etc. and having a depth of approximately two (2) inches. As shown in FIGS. 3–6, the top of the surface cover layer 7 is configured at approximately the same elevation as the top of curb 2. Behind the bed 9 and cover layer 7 is the impact element line 4 that preferably includes a low wall extending approximately sixteen (16) inches above the top of the cover layer, and having a length of approximately twelve (12) inches and a width corresponding to the width of at least one of the bed, the cover layer 7, and the foundation 8. According to alternative embodiments, the dimensions of the curb, and the bed, and the confining structure and the impact element line may be varied to suit a particular application.

The impact element line 4 of the vehicle barrier system 11 may also be provided as "inertia" or "friction" type barriers that are intended to rely on their weight and friction with the surface on which they are placed to provide a desired degree of impact resistance. Such inertia type impact elements may be "preformed" concrete structures (such as commonly known as "jersey barriers") or concrete "planters" or the like that are intended for placement at a desired location. The inertia type impact elements are advantageous for "temporary" type barrier systems, in which the impact elements may only be required for a relatively short time period, or where subgrade conditions prevent easily constructing a foundation, as in the case of shallow depth utility lines, etc. However, such inertia type impact elements typically involve more material located above the surface of the roadway than foundation type impact elements which are integrated into a foundation. According to a preferred embodiment, the inertia type impact elements are provided with an outer shell material (such as, for example, bronze to enhance aesthetic appeal) and an internal ballast (e.g. concrete, metal, etc.) to provide a weight of approximately 6000 pounds (lbs) (such as for use in applications classified as "high threat" areas). According to a particularly preferred embodiment, the inertia type impact elements are provided in dimensions of approximately 30 inches high, 30 inches wide and 48 inches deep. According to alternative embodiments, the impact elements of the inoperable barriers may be provided as foundation type impact elements integrated into a foundation (e.g. sidewalk, roadway, ground area, subgrade foundation, etc.). According to another alternative embodiment, the inertia type impact elements may be provided in any suitable size, shape, weight and surface texture to provide the desired impact resistance for a particular application (such as, for example, a weight less than 6000 lbs. for use in applications classified as "low threat" etc.).

According to any exemplary embodiment of the present invention, the vehicle barrier system is intended to provide an installed barrier for use along a boundary or border such as a security perimeter to protect sites that may be susceptible to a vehicle born intrusion or attack. The vehicle barrier system is designed so that in can be crossed by pedestrians and the like, but prevents passage by vehicles such as automobiles. The vehicle barrier systems employs a variable "composite" approach, using a combination of different attenuation devices and methods in succession to stop a vehicle within a short distance or limited space, such as are typically encountered near buildings and the like. The vehicle barrier system is intended to provide an installed barrier having a "rating" as a crash type barrier consistent with applicable governmental rating criteria. For example, the vehicle barrier system is intended to provide a rating of at least any one of the following K ratings (i.e. a measure of the barrier's potential to stop a vehicle at escalating speed as dictated by standards determined by the U.S. Department of State: K4 (15,000 lb vehicle traveling at 30 miles per hour (mph)), K8 (15,000 lb vehicle traveling at 40 mph), or K12 (15,000 lb. vehicle traveling at 50 mph.

It is also important to note that the construction and arrangement of the elements of the vehicle barrier system as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sequence, sizes, dimensions, structures, shapes, profiles and proportions of the various elements, values of parameters, mounting arrangements, use of materials, ballast, orientations, compositions of compressible materials, etc.) without materially departing from the novel teachings and advantages of the subject matter recited. For example, elements shown as integrally formed may be constructed of multiple parts or elements show as multiple parts may be integrally formed. By further way of example, the deformable zone may include a bed having any suitable structure or material configured to support the weight of pedestrians and other generally permissible loads, but is configured to deform sufficiently under the weight of a vehicle or other generally impermissible loads so that the elevation of the vehicle is lowered in relation to the surface grade and to facilitate contact of the vehicle chassis with a second impact element that may have a generally lowered elevation. It should also be noted that the system may be used in association with a wide variety of applications (e.g. corporations, government facilities, entertainment venues, private residences, hospitals, hotels, religious and cultural institutions, etc.) and that the elements of the system may be provided in any suitable size, shape, material and appearance that meets applicable design and performance standards and that creates a desired appearance corresponding to the location of the system. Accordingly, all such modifications are intended to be included within the scope of the present inventions. Other substitutions, modifications, changes and omissions may be made in the design, operating conditions and arrangement of the preferred and other exemplary embodiments without departing from the spirit of the present inventions.

The order or sequence of any process or method steps may be varied or re-sequenced according to alternative embodiments. Other substitutions, modifications, changes and omissions may be made in the design, operating configuration and arrangement of the preferred and other exemplary embodiments without departing from the spirit of the inventions as expressed in the appended claims.

What is claimed is:

1. A security barrier system for use with a trafficable surface and a site requiring protection from advancing vehicles, comprising:

a bed having a first region adjacent to the trafficable surface and a second region opposite the first region, the bed comprising a deformable material configured to deform under the weight of a vehicle to thereby lower an elevation of a vehicle that encounters the bed;

a raised element disposed between the trafficable surface and the bed, the raised element having a height extending above the trafficable surface;

a cover layer comprising a planting material arranged on top of the bed; and an impact resistant barrier adjacent to the second region of the bed, the impact resistant barrier having a height configured to impact and stop a lowered vehicle that traverses the bed.

2. The system of claim 1 wherein the cover layer conceals the bed.

3. The system of claim 1 wherein the deformable material of the bed comprises a cellular concrete material.

4. The system of claim 1 wherein the impact resistant barrier has an elevation substantially even with a top surface of the bed.

5. The system of claim 1 wherein the impact resistant barrier extends above a top surface of the bed and at least partially defines a protected zone adjacent to the site.

6. The system of claim 1 wherein the deformable material has a strength sufficient to support non-vehicular traffic but insufficient to support vehicular traffic without substantial deformation.

7. The system of claim 1 wherein the trafficable surface has a composite coefficient of friction that is greater than asphalt or concrete.

8. The system of claim 1 wherein the raised element comprises a curb between the trafficable surface and the first region of the bed having a height extending above the trafficable surface and substantially even with a top of the bed and configured to cause a vehicle's front wheels to lose contact with the trafficable surface when the front wheels impact the curb.

9. The system of claim 8 wherein the height of the curb is within the range of approximately 3–12 inches above the trafficable surface.

10. The system of claim 8 wherein the curb is formed from a material comprising at least one of stone, reinforced concrete, and wood.

11. The system of claim 8 wherein the curb is at least partially enclosed in a steel cover.

12. The system of claim 8 wherein the curb is linked to a reinforced concrete foundation.

13. The system of claim 3 wherein the cellular concrete material has a minimum compressive strength of approximately 30 psi.

14. The system of claim 3 wherein the cellular concrete material has a maximum compressive strength of approximately 60 psi.

15. The system of claim 3 wherein the cellular concrete material has a compressive strength configured to deform under the weight of a tire of a vehicle that is loaded to at least approximately 2,500 lbs.

16. The system of claim 3 wherein the cellular concrete material contains voids filled with air.

17. The system of claim 1 wherein the impact resistant barrier further comprises a confining structure configured to at least partially contain the bed.

18. The system of claim 1 wherein the impact resistant barrier comprises a retaining wall that uses at least one of reinforced concrete, soil, brick, sheet metal, fabric, plastic, wood, and a composite material.

19. The system of claim 2 wherein the planting material comprises at least one of soil, sedum, and grass.

20. The system of claim 2 wherein a top of the cover layer is at a substantially equivalent elevation with a top of a curb between the trafficable surface and the bed.

21. The system of claim 2 wherein the cover layer is arranged on an incline.

22. The system of claim 1 wherein the impact resistant barrier comprises at least one bollard.

23. The system of claim 22 wherein the at least one bollard is a plurality of bollards connected by beams.

24. The system of claim 23 wherein the beams are at least partially enclosed by a cover configured for pedestrian seating.

25. The system of claim 1 wherein the impact resistant barrier comprises wall sections.

26. The system of claim 25 wherein the wall sections are at least partially covered for use as a bench.

27. The system of claim 1 wherein the impact resistant barrier comprises inertia barriers.

28. The system of claim 27 wherein the inertia barriers are at least one of a jersey barrier and a concrete planter.

29. The system of claim 1 wherein the height of the impact resistant barrier is less than or equal to approximately 36 inches above a surface of the bed.

30. The system of claim 1 wherein the barrier system further comprises a crash rating.

31. The system of claim 30 wherein the crash rating is a K rating as defined by the United States Department of State.

32. The system of claim 1 wherein the impact resistant barrier comprises a crash barrier.

33. An adaptable vehicle security barrier system comprising:

a curb positioned between a trafficable surface and a bed, the curb extending above the trafficable surface to direct a vehicle upwardly so that at least a portion of the vehicle descends into the bed;

the bed configured to substantially resist deformation under pedestrians and to deform under the weight of a vehicle so that an elevation of the vehicle is lowered;

an impact element having a height and an impact resistance suitable to stop a vehicle after the elevation of the vehicle is lowered by the bed;

so that the vehicle is prevented from progressing substantially beyond the impact element.

34. The system of claim 33 wherein the bed further comprises a length of at least one of a deformable structure having a deformability and a deformable material having a deformability.

35. The system of claim 34 wherein the height is configured to be decreased by increasing at least one of the length and the deformability.

36. The system of claim 34 wherein the length is configured to be decreased by at least one of increasing the height and increasing the deformability.

37. The system of claim 34 wherein the deformable structure comprises at least one or a combination of a framework, a lattice and a honeycomb.

38. The system of claim 34 wherein the deformable structure comprises a metal material, a polycarbonate material, a plastic material, and a composite metallic material.

39. The system of claim 34 wherein the deformable material comprises at least one of a cellular concrete material, a metallic foam and a polymeric foam.

40. The system of claim 33 wherein the bed is at least partially contained within a confining structure.

41. The system of claim 33 further comprising a cover layer configured to at least partially overlay the bed and assist the bed in substantially preventing deformation under pedestrians but continue to permit deformation of the deformable material under vehicles.

42. The system of claim 33 wherein the impact element comprises a crash barrier.

43. The system of claim 34 wherein the deformable material comprises a material having a plurality of voids.

44. The system of claim 43 wherein the deformable material comprises at least one of a cellular concrete material, a metallic foam material and a polymeric foam material.

45. The system of claim 33 wherein the height is less than approximately three feet above a surface of the bed.

46. The system of claim 33 wherein a top surface of the bed is arranged at an elevation above the trafficable surface.

47. The system of claim 46 wherein the curb has a lower section adjacent to the trafficable surface and an upper section adjacent to the top surface of the bed.

48. A security barrier system for use with a trafficable surface for vehicles and a site requiring protection from advancing vehicles, comprising:

a bed adjacent to the trafficable surface, the bed comprising a deformable material having a strength sufficient to support non-vehicular traffic, but insufficient to support the weight of a vehicle to thereby lower an elevation of a vehicle that encounters the bed;

a curb between the trafficable surface and the bed, the curb having a height extending above the trafficable surface;

a pedestrian tread surface comprising a decorative paving material arranged on top of the bed to distribute pedestrian loads on the bed; and an impact resistant barrier adjacent to the bed, the impact resistant barrier having a height configured to impact and stop a lowered vehicle that traverses the bed.

49. The system of claim 48 wherein the pedestrian tread surface conceals the bed.

50. The system of claim 48 wherein the deformable material of the bed comprises a cellular concrete material.

51. The system of claim 48 wherein the deformable material has a compressive strength configured to deform under the weight of a tire of a vehicle that is loaded to at least approximately 2,500 lbs.

52. The system of claim 48 wherein the impact resistant barrier extends above a top surface of the bed and at least partially defines a protected zone adjacent to the site.

53. The system of claim 48 wherein the curb is configured to cause a vehicle's front wheels to lose contact with the trafficable surface when the front wheels impact the curb.

54. The system of claim 48 wherein the impact resistant barrier comprises a retaining wall that uses at least one of reinforced concrete, soil, brick, sheet metal, fabric, plastic, wood and a composite material.

55. The system of claim 48 wherein the decorative paving material of the pedestrian tread surface comprises at least one of stone, brick, payers, tiles, and cobble.

56. The system of claim 48 wherein the impact resistant barrier comprises at least one bollard.

57. The system of claim 56 wherein the at least one bollard is a plurality of bollards connected by beams.

58. The system of claim 57 wherein the beams are at least partially enclosed by a cover configured for pedestrian seating.

59. The system of claim 48 wherein the impact resistant barrier comprises wall sections.

60. The system of claim 59 wherein the wall sections are at least partially covered for use as a bench.

61. The system of claim 48 wherein the impact resistant barrier comprises a crash barrier.

62. The system of claim 48 wherein the impact resistant barrier has an elevation substantially even with a top surface of the bed.

* * * * *